United States Patent [19]

Kodama

[11] Patent Number: 4,926,013

[45] Date of Patent: May 15, 1990

[54] DISTRIBUTOR CAP WITH MOLDED CABLE TERMINALS

[75] Inventor: Seiki Kodama, Hyogo, Japan

[73] Assignee: Mitsubishi Denki Kabushiki Kaisha, Tokyo, Japan

[21] Appl. No.: 238,078

[22] Filed: Aug. 30, 1988

[30] Foreign Application Priority Data

Sep. 16, 1987 [JP] Japan ..... 62-231522
Sep. 16, 1987 [JP] Japan ..... 62-141017[U]
Sep. 16, 1987 [JP] Japan ..... 62-141018[U]

[51] Int. Cl.[5] ..... H01H 19/00; F02P 7/02; H01F 31/00

[52] U.S. Cl. ..... 200/19 DC; 200/19 R

[58] Field of Search ..... 200/19 R, 19 A, 19 DC, 200/19 DR, 19 EL, 19 L, 19 M, 19 TS, 19 WG, 302.1; 29/883

[56] References Cited

U.S. PATENT DOCUMENTS 4,631,369 12/1986 Ohashi ..... 200/19 R

FOREIGN PATENT DOCUMENTS 59-24868 7/1984 Japan .

*Primary Examiner*—J. R. Scott
*Attorney, Agent, or Firm*—Sughrue, Mion, Zinn, Macpeak and Seas

[57] ABSTRACT

A distributor cap comprises an ignition cable having a core wire exposed at one end thereof, a terminal member secured to the end portion of the ignition cable such that the terminal member is in contact with the core wire, a primary mold of a melt- adhesive resin material which is formed such as to cover that end portion of the ignition cable to which the terminal member is secured, and a synthetic resin cap body which is cast such as to wrap the primary mold. Formation of the primary mold enables the ignition cable and the terminal member to be reliably connected together in one unit and also makes it possible to secure the electrical connection between the core wire of the ignition cable and the terminal member. The primary mold is softened and fusion-welded to the cap body by heating applied during the cap body molding process. Thus, the area between the ignition cable and the synthetic resin cap body is hermetically sealed and the cable and the cap body are firmly connected together in one unit, so that it is possible to obtain superior waterproofness and dustproofness.

9 Claims, 5 Drawing Sheets

DISTRIBUTOR CAP WITH MOLDED CABLE TERMINALS

BACKGROUND OF THE INVENTION

1. Field of the Invention

The present invention relates to a cap of a distributor for use in an electric ignition device for an internal combustion engine. More particularly the present invention pertains to an improvement in the connection of the distributor cap and an ignition cable.

2. Description of the Prior Art

FIG. 1 shows a typical conventional distributor cap of the type described above. Referring to the figure, the reference numeral 1 denotes a distributor cap body made of a synthetic resin material. The cap body 1 has a central projection 1*a* and a plurality of side projections 1*b*, which are formed on the upper side thereof so as to project upward as viewed in the figure. The reference numeral 2 denotes a central terminal which is buried in the central projection 1*a*. The central terminal 2 has a contact member 4 vertically movably supported within the lower portion thereof through a compression spring 3 which biases the contact member 4 downward. The reference numeral 5 denotes a side terminal which is buried in each side projection 1*b*. A distributing member 6 which is shown by the two-dot chain line is fitted to a rotor 7. The distributing member 6 has a distributing conductor strip 8 buried in the upper surface thereof. The conductor strip 8 is in resilient contact with the contact member 4. Thus, as the distributing member 6, together with the rotor 7, rotates, the distal end of the conductor strip 8 comes to close proximity to the side terminals 5 to apply a high voltage thereto sequentially.

The reference numeral 9 denotes a central ignition cable which is connected to the secondary winding (not shown) of an ignition coil, 10 is a side ignition cable connected to each ignition plug (not shown), 11 is a plug-in terminal which is press fitted on the terminating end of the ignition cable 9 to connect with the core wire 9*a* and which is plugged in and thereby brought into contact with the central terminal 2, and 12 is a plug-in terminal which is press-fitted on each ignition cable 10 to connect with the core wire 10*a* and which is plugged in and thereby brought into contact with the side terminal 5. The reference numeral 13 denotes an elastic cover which is made of a rubber-like elastic insulating material, the elastic cover 13 being fitted on each of the ignition cables 9 and 10 and having the inner peripheral portion of its distal end fitted on each of the projections 1*a* and 1*b*, thus serving as insulating and waterproofing means.

The above described conventional distributor cap suffers, however, from the following problems. Namely, there is a fear of contact failure occurring between the plug-in terminals 11 and 12 on the one hand and the central and side terminals 2 and 5 on the other due to vibrations or insufficient plugging. In addition, the elastic retaining capability of the elastic covers 13 may be deteriorated due to overheat, corona discharge or the effect of water, oil or the like to such an extent that the ignition cables 9 and 10 cannot be sufficiently retained, which leads to various problems, for example, electrical contact failure, waterproofness failure and disengagement of the ignition cables 9, 10.

BRIEF SUMMARY OF THE INVENTION

It is an object of the present invention to provide a distributor cap which is designed so that the electrical connection between a terminal member fitted on an end portion of an ignition cable and the core wire of the ignition cable can be maintained with a high degree of reliability, and also provide a process for producing the distributor cap.

It is another object of the present invention to provide a distributor cap which is designed so that it is possible to eliminate the need for waterproof and dustproof elastic covers which have heretofore been attached to the conventional distributor cap and also the need for plug-in terminals which have been attached to the respective ends of ignition cables of the prior art, thereby enabling simplification of the cap structure and facilitation of the manufacture, and also provide a process for producing the distributor cap.

It is still another object of the present invention to provide a distributor cap which is designed so that it is possible to enhance the waterproofness and dustproofness at the area between ignition cables and a synthetic resin cap body, and also provide a process for producing the distributor cap.

It is a further object of the present invention to provide a distributor cap wherein, among terminal members which are fitted to respective ignition cables, the terminal members for side ignition cables are formed by press working a sheet of an electrically conductive metal, and also provide a process for producing the distributor cap.

It is a still further object of the present invention to provide a distributor cap having a central ignition cable secured to the central portion of a synthetic resin cap body and a plurality of side ignition cables disposed around the central ignition cable, and also provide a process for producing the distributor cap.

It is a still further object of the present invention to provide a distributor cap wherein, among terminal members which are fitted to respective ignition cables, each of the terminal members for side ignition cables comprises a connecting cap portion attached to the end portion of the corresponding side ignition cable and a terminal strip portion which is rigidly secured to the top portion of the connecting cap portion by means of caulking, and also provide a process for producing the distributor cap.

A distributor cap according to the present invention comprises: an ignition cable having a core wire exposed at one end thereof; a terminal member secured to the end portion of the ignition cable such that the terminal member is in contact with the core wire; a primary mold of a melt-adhesive resin material which is formed such as to cover that end portion of the ignition cable to which the terminal member is secured; and a synthetic resin cap body which is cast such as to wrap the primary mold.

To produce the distributor cap according to the present invention, a terminal member is fitted on an ignition cable having a core wire exposed at one end thereof and the terminal member is brought into electrical contact with the core wire. Next, the outer periphery of that end portion of the ignition cable to which the terminal member is fitted is covered with a primary mold of a melt adhesive resin material. This primary mold is formed such as to cover both the terminal member and the outer periphery of the end portion of the ignition cable, but the distal end portion of the terminal member must not be covered with the primary mold but exposed. Formation of the primary mold enables the ignition cable and the terminal member to be reliably connected together in one unit and also makes it possible to secure the electrical connection between the core wire of the ignition cable and the terminal member. Then, the ignition cable is secured to a synthetic resin cap body in such a manner that a synthetic resin material is cast such as to wrap the primary mold formed on the end portion of the ignition cable, thereby molding a synthetic resin cap body and connecting together the ignition cable and the cap body in one unit. At this time, heating applied during the cap body molding process causes the resin material of the primary mold to soften and integrally fusion-weld to the cap body. Thus, the area between the ignition cable and the synthetic resin cap body is hermetically sealed and the cable and the cap body are firmly connected together in one unit, so that it is possible to obtain superior waterproofness and dustproofness.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like members, and of which.

DETAILED DESCRIPTION OF THE INVENTION

Figure 1:
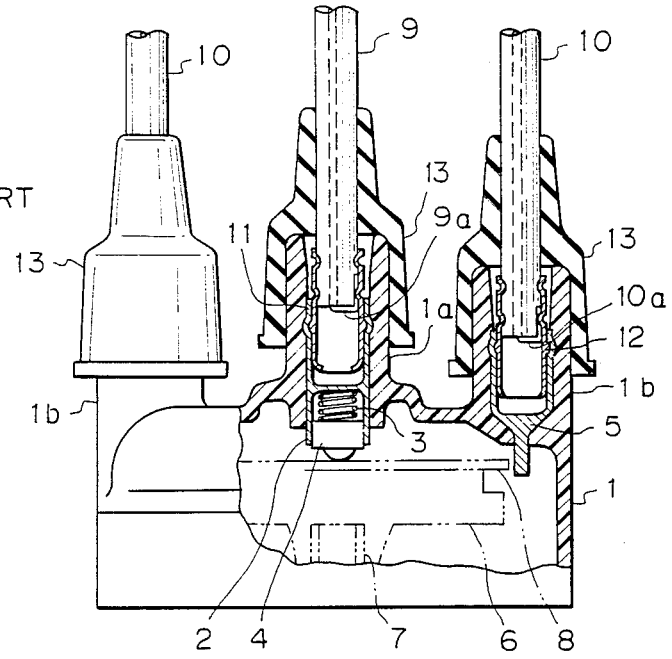
Fig. 1 PRIOR ART
FIG. 1 is a partly-sectioned front view of a conventional distributor cap.

FIGS. 2 to 6 show in combination a first embodiment of the present invention. In this embodiment, a central terminal member 22 is fitted on the terminating end of a central ignition cable 9 which is connected to the central portion of a distributor cap body 21. The central terminal member 22 is connected to the core wire 9*a* of the central ignition cable 9. A contact member 23 made of a carbon material is vertically movably retained at the lower end portion of the central terminal member 22. The contact member 23 is biased by a coned disc spring 24 in a direction in which it projects from the lower end of the central terminal 22. The distributor cap body 21 further has a plurality of side ignition cables 10 secured thereto. These side ignition cables 10 are disposed around the central ignition cable 9. A side terminal member 25 is fitted on the terminating end of each side ignition cable 10 and connected to the core wire 10*a* of the cable 10. The terminal members 22 and 25 are formed by cold forging. A primary mold 26 which is made of a melt-adhesive resin material is formed on the outer periphery of the terminating end portion of each of the ignition cables 9 and 10 in such a manner that the distal end portion of the corresponding terminal member 22 (or 25) is exposed.

Figure 3:
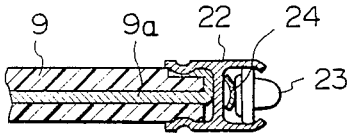
FIG. 3 is a sectional view showing a central ignition cable which is connected to the distributor cap shown in FIG. 2, the central ignition cable having a terminal member fitted thereon.
Figure 4:
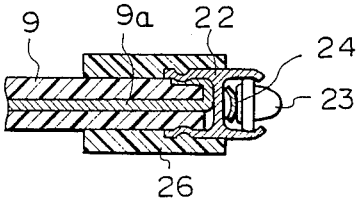
FIG. 4 is a sectional view showing the central ignition cable shown in FIG. 3 which has a primary mold formed thereon.
Figure 5:
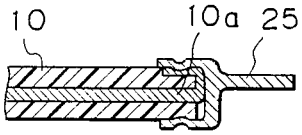
FIG. 5 is a sectional view showing a side ignition cable which is connected to the distributor cap shown in FIG. 2, the side ignition cable having a terminal member fitted thereon.
Figure 6:
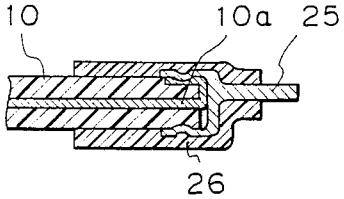
FIG. 6 is a sectional view of the side ignition cable shown in FIG. 5 which has a primary mold formed thereon.

FIG. 3 shows the central ignition cable 9 which has the central terminal member 22 fitted thereon, while FIG. 4 shows the central ignition cable 9 which has the primary mold 26 of a melt-adhesive resin material formed thereon. FIG. 5 is a sectional view of one of the side ignition cables 10 which has the side terminal member 25 fitted thereon, while FIG. 6 is a sectional view showing the side ignition cable 10 shown in FIG. 5 which has the primary mold 26 formed thereon. As will be clear from FIGS. 4 to 6, the primary molds 26 are formed so as to cover the respective end portions of the cables 9 and 10 such that the distal end portions of the terminal members 22 and 25 are exposed, thereby rigidly securing the terminal members 22 and 25 to the respective end portions of the cables 9 and 10 and reliably maintaining the electrical contact between the terminal members 22 and 25 on the one hand and the core wires 9a and 10a on the other.

Figure 2:
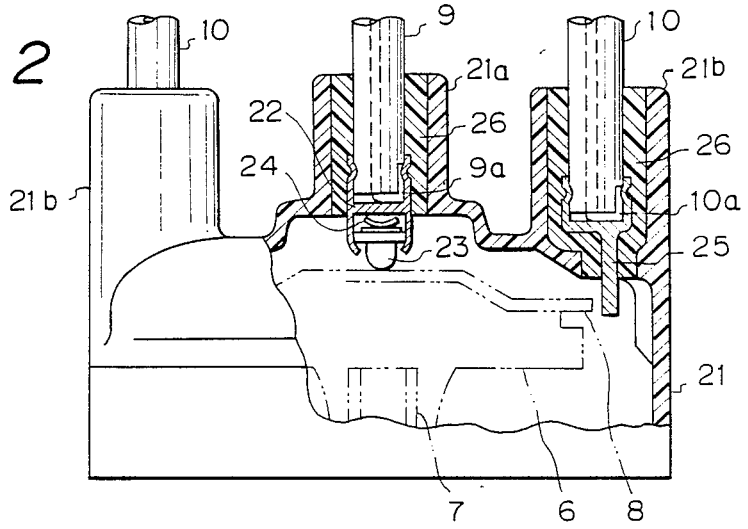
FIG. 2 is a partly-sectioned front view of a first embodiment of the distributor cap according to the present invention.

The primary mold portions 26 of the ignition cables 9 and 10 having their terminating end portions treated as described above are disposed at predetermined positions, respectively, in a resin molding die (not shown) for molding a cap body, and a synthetic resin is poured into the die and then heated and pressed to form a cap body 21 (see FIG. 2). As will be clear from FIG. 2, the primary mold portion 26 of the central ignition cable 9 is rigidly secured within a central projection 21a of the cap body 21, while the primary mold portion 26 of each side ignition cable 10 is rigidly secured within a side projection 21b of the cap body 21. Heating applied during the process for molding the cap body 21 causes the primary molds 26 to soften and fusion-weld to the respective projections 21a and 21b of the cap body 21. Thus, the required airtightness and waterproofness at the area between the cables 9, 10 and the projections 21a, 21b of the cap body 21 are ensured and the cables 9 and 10 are reliably secured to the cap body 21.

Figure 7:
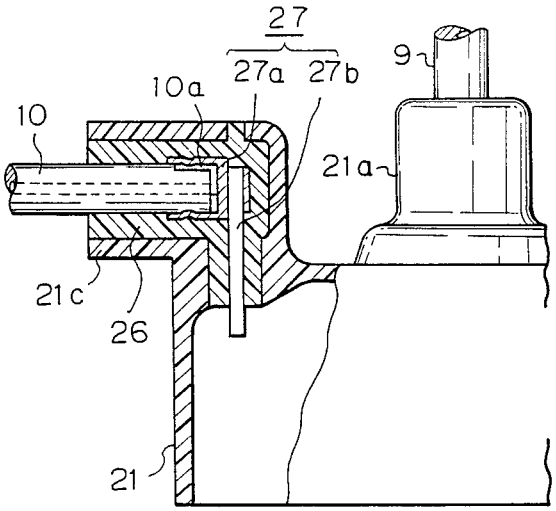
FIG. 7 is a partly-sectioned front view of a second embodiment of the distributor cap according to the present invention.
Figure 9:
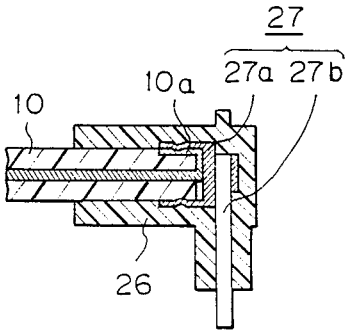
FIG. 9 is a sectional view of the side ignition cable shown in FIG. 8 which has a primary mold formed thereon.
Figure 8:
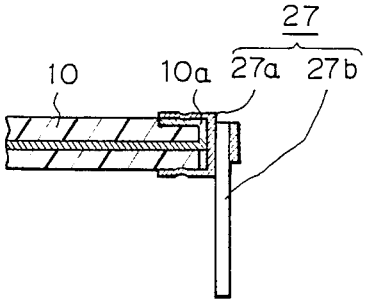
FIG. 8 is a sectional view showing a side ignition cable which is connected to the distributor cap shown in FIG. 7, the side ignition cable having a terminal member fitted thereon.

FIG. 7 shows a second embodiment of the distributor cap according to the present invention. The feature of this embodiment resides in that each side ignition cable 10 projects sideward of the cap body 21 from the corresponding side projection 21c of the cap body. More specifically each side terminal member 27 comprises, as shown in FIG. 8, a connecting cap portion 27a and a terminal strip 27b which is secured to the top portion of the connecting cap portion 27a by means of caulking. The side terminal member 27 having the described arrangement is fitted on the end portion of the side ignition cable 10 and brought into electrical contact with the core wire 10a of the cable 10. The outer periphery of the terminating end portion of the ignition cable 10 in this state is covered with a primary mold 26 of a melt-adhesive resin material, as shown in FIG. 9, thus rigidly securing the side terminal member 27 to the terminating end portion of the cable 10 by means of the primary mold 26. The ignition cable 10 having its terminating end portion thus treated is disposed within a molding die (not shown) in such a manner that the primary mold portion 26 will be positioned within the corresponding side projection 21c of the cap body 21. In this state, a synthetic resin material is poured into the die and then heated as well as pressed to form the cap body 21, as shown in FIG. 7. The arrangement of the other portions is the same as in the above-described first embodiment.

Figure 10:
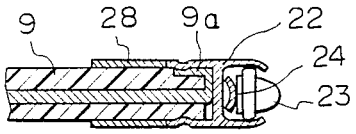
FIG. 10 is a sectional view of another example of the central ignition cable connected to the distributor cap according to the present invention, which shows the central ignition cable having a terminal member fitted thereon.
Figure 11:
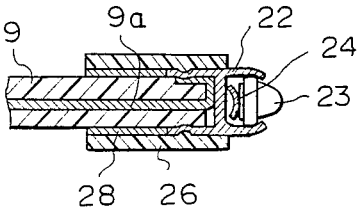
FIG. 11 is a sectional view of the central ignition cable shown in FIG. 10 which has a primary mold formed thereon.
Figure 12:
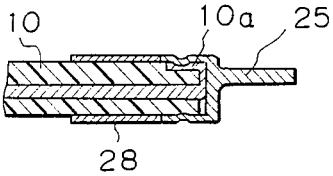
FIG. 12 is a sectional view of another example of the side ignition cable connected to the distributor cap according to the present invention shown in FIG. 2, which shows the side ignition cable having a terminal member fitted thereon.
Figure 13:
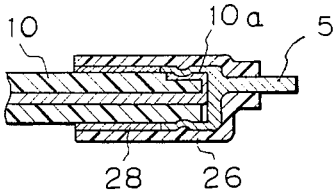
FIG. 13 is a sectional view of the side ignition cable shown in FIG. 12 which has a primary mold formed thereon.
Figure 14:
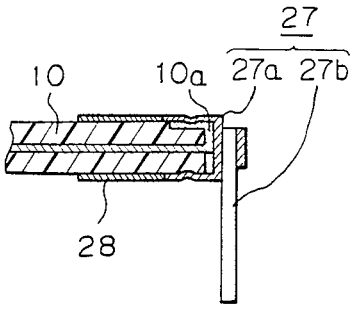
FIG. 14 is a sectional view of another example of the side ignition cable connected to the distributor cap according to the present invention shown in FIG. 7, which shows the side ignition cable having a terminal member fitted thereon.
Figure 15:
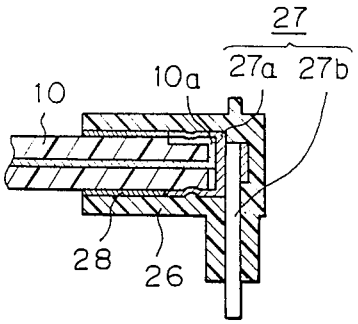
FIG. 15 is a sectional view of the side ignition cable shown in FIG. 14 which has a primary mold formed thereon.
Figure 16:
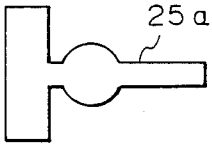
FIG. 16 shows a stock used to form another example of the terminal member for a side ignition cable which is connected to the distributor cap according to the present invention.

FIGS. 10 to 15 show other examples of the cables which are secured to the distributor cap according to the present invention, in which: FIGS. 10 and 11 show another example of the central ignition cable; FIGS. 12 and 13 show another example of the side ignition cables secured to the cap shown in FIG. 2; and FIGS. 14 and 15 show another example of the side ignition cables secured to the cap shown in FIG. 7. The feature of the ignition cables 9 and 10 shown in FIGS. 10 to 15 resides in that a connection tube 28 which is made of a melt adhesive resin material is fitted on the cable 9 (10) at a position adjacent to the terminal member 22 (25, 27), and the connection tube 28 and the terminal member 22 (25, 27) are covered with the primary mold 26. By virtue of this arrangement, heating applied when the primary mold 26 is formed allows the connection tube 28 to fuse and hermetically bond together the ignition cable 9 (10) and the primary mold 26, thus enabling further improvements in the waterproofness and dustproofness at the area between the ignition cables 9, 10 and the primary molds 26. The arrangement of the other portions is the same as in the above-described embodiments.

Figure 17:
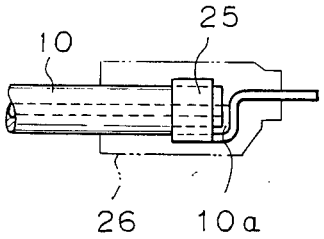
FIG. 17 is a side view of the terminal member formed from the terminal stock shown in FIG. 16 which is secured to an ignition cable for distributor cap shown in FIG. 2.
Figure 18:
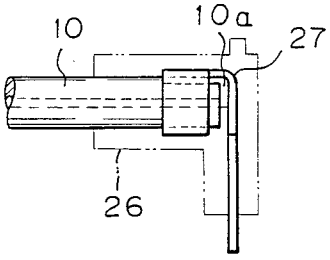
FIG. 18 is a side view of the terminal member formed from the terminal stock shown in FIG. 16 which is secured to an ignition cable for the distributor cap shown in FIG. 7.
Figure 19:
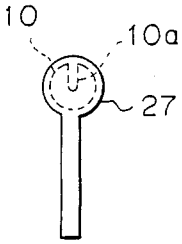
FIG. 19 is a side view of the terminal member shown in FIG. 18 as viewed from the right-hand side thereof.

FIGS. 16 to 19 show in combination another example of the side terminal member which is secured to each side ignition cable 10. In these drawings, FIG. 10 shows a terminal stock 25a formed by press cutting a sheet of an electrically conductive metal. The terminal stock 25a is subjected to press working to form a side terminal member 25 such as that shown in FIG. 17. The side terminal member 25 is attached to the cap shown in FIG. 2. More specifically, the side terminal member 25 is fitted on the end portion of the side ignition cable 10, and a primary mold 26 is formed so as to cover the outer periphery of the end portion of the side ignition cable 10, as shown in FIG. 17. FIG. 18 shows a side ignition cable 10 which is connected to the cap shown in FIG. 7. A side terminal member 27 which is secured to this side ignition cable 10 is also formed by press working the terminal stock 25a shown in FIG. 16 into a configuration such as that shown in FIGS. 18 and 19. The side terminal member 27 is fitted on the end portion of the side ignition cable 10 and, in this state, a primary mold 26 is formed so as to cover the outer periphery of the end portion of the cable 10. Thus, if each of the side terminal members is formed by press working a sheet of an electrically conductive metal, it is possible to facilitate the manufacture of terminal members, improve the mass-productivity and lower the production cost.

What is claimed is:

1. A distributor cap comprising:

a plurality of ignition cables;

a plurality of core wires individually extending through said ignition cables and having one ends thereof exposed at one ends of said ignition cables;

a plurality of terminal members individually fitted on outer peripheral surfaces of said one ends of said ignition cables, said terminal members being in electrical contact with said core wires;

a plurality of primary molds of a melt-adhesive resin material individually covering both said terminal members and said outer peripheral surfaces of said one ends of said ignition cables in such a manner that distal end portions of said terminal members are exposed; and a synthetic resin cap body formed integral with said ignition cables and surrounding said primary molds.

2. A distributor cap according to claim 1, wherein said ignition cables comprise a central ignition cable secured to a central portion of said synthetic resin cap body and a plurality of side ignition cables secured to said synthetic resin cap body and disposed around said central ignition cable.

3. A distributor cap according to claim 1, wherein said synthetic resin cap body has a plurality of projections which individually surround peripheral surfaces of said primary molds, said primary molds being fusion-welded to said synthetic resin cap body.

4. A distributor cap according to claim 3, wherein said projections comprise a central projection formed on a central portion of said synthetic resin cap body and a plurality of side projections formed on said synthetic resin cap body such as to surround said central projection.

5. A distributor cap according to claim 2, wherein said terminal members comprise a central terminal member fitted on said one end of said central ignition cable and side terminal members respectively fitted on said side ignition cables, each side terminal member comprising a connecting cap portion fitted on the outer peripheral surface of said one end of a corresponding side ignition cable and a terminal strip portion rigidly secured to a top portion of said connecting cap portion.

6. A distributor cap according to claim 1, wherein said terminal member is cold forged.

7. A distributor cap according to claim 5, wherein said central terminal member slidably retains a contact member which is in contact with a distributing conductor strip of a distributor, said contact member being biased by a coned disc spring in a direction in which it projects from said central terminal member.

8. A distributor cap according to claim 5, wherein each of said side terminal members comprises a press worked sheet of an electrically conductive metal.

9. A distributor cap according to claim 1, wherein a plurality of connection tubes of a melt-adhesive resin material are individually fitted on the outer peripheral surfaces of said ignition cables at positions adjacent to said terminal members, said connection tube being fusion-welded to both said ignition cables and said primary molds.

* * * * *